US005279019A

United States Patent [19]

Knickle

[11] Patent Number: 5,279,019

[45] Date of Patent: Jan. 18, 1994

[54] CREDIT CARD AND MONEY CARRYING DEVICE

[76] Inventor: James P. Knickle, 3403 Gallows Rd., Falls Church, Va. 22042

[21] Appl. No.: 997,783

[22] Filed: Dec. 29, 1992

[51] Int. Cl.[5] ..... A44B 21/00; A45F 5/00

[52] U.S. Cl. ..... 24/17 B; 24/3 L; 24/301

[58] Field of Search ....24/17B, 17R, 3M, 3L, 336, 300, 301, 482-3

[56] References Cited

U.S. PATENT DOCUMENTS

| | | | |
|---|---|---|---|
| 132,230 | 10/1872 | Arms | 24/17 B |
| 151,036 | 5/1874 | Liebenroth | 24/17 B |
| 152,876 | 7/1874 | Smith | 24/17 B |
| 212,578 | 2/1879 | Smith | 24/17 B |
| 956,534 | 5/1910 | Lahey | 24/17 B |
| 1,245,455 | 11/1917 | Gilchrist | 24/17 B |
| 1,960,690 | 5/1934 | Blair | 24/17 B |
| 3,073,439 | 1/1963 | Symmonds, Jr. | 24/16 R |
| 5,052,602 | 10/1991 | Duchi, Jr. et al. | 24/301 |
| 5,077,869 | 1/1992 | Haase | 24/3 L |

FOREIGN PATENT DOCUMENTS

| | | | |
|---|---|---|---|
| 0000212 | of 1880 | United Kingdom | 24/17 B |

*Primary Examiner*—Victor N. Sakran
*Attorney, Agent, or Firm*—John S. Hale

[57] ABSTRACT

A credit card and money carrying device comprising an endless band of elastic material, a plate member folded around the elastic band and crimped providing engagement of the crimped portion of the plate member into the elastic band.

5 Claims, 2 Drawing Sheets

FIG.1
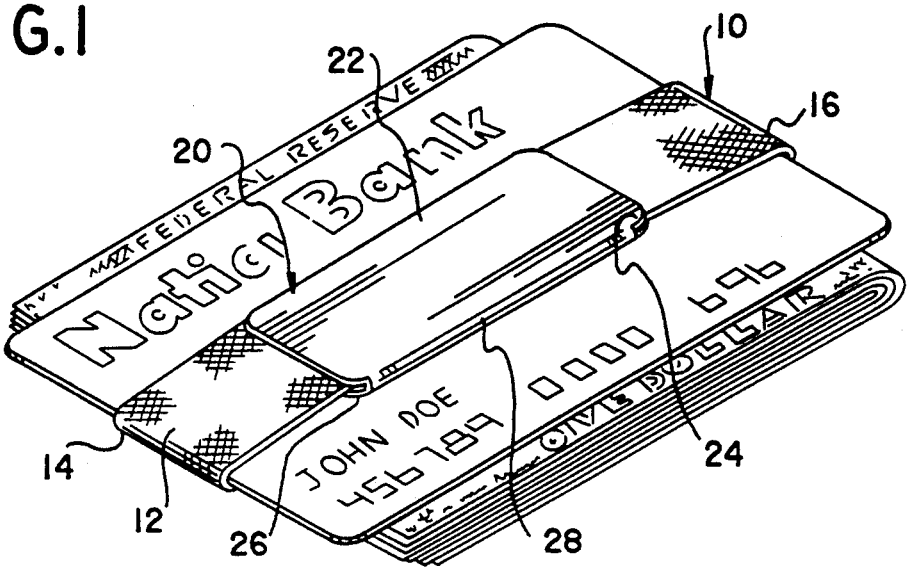
FIG.2
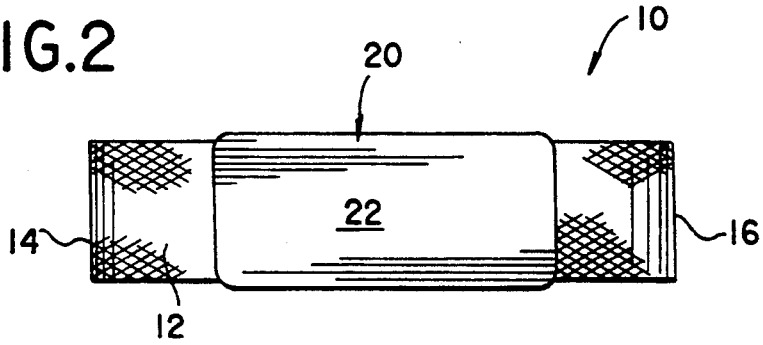
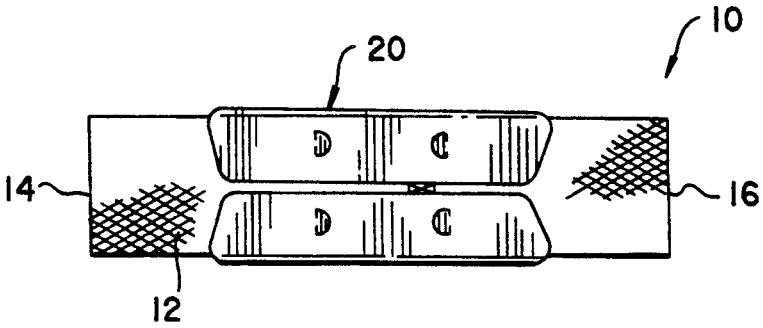
FIG.3

CREDIT CARD AND MONEY CARRYING DEVICE

BACKGROUND OF THE INVENTION

The present invention is directed towards a new and improved credit card and money carrying device for holding foldable currency and credit type cards or identification cards together in a convenient, easy to use arrangement.

Money clips have been used for a long time to hold folded currency and are designed to be carried in a pants or jacket pocket or other area. These money clips are fashioned from a single piece of bent or formed metal stock generally in the form of a spring clip and are available in plated or solid precious metals, stainless steel, bronze or nickel.

The demise of popularity for the money clip in the past decade can be directly attributed to the demand for and growth in the use of credit cards and the accompanying need to conveniently and securely carry on one's person. This change has been brought about by the emergence of the credit card and its impact on society, banking and the very nature of monetary transactions. The credit card has now become a standard item for most adults in the United States. Each card complies with a defacto standard with respect to size, shape, dimensions and weight. The proliferation of these credit card sized devices hall led to the adoption of the same sized devices for use in a wide array of identification cards. These include ATM cards, bank cards, phone cards, driver's licenses, smart keys and other identification cards.

Most money clips do not adequately accommodate credit cards and other types of cards, many which were originally designed prior to the widespread use of credit and other type cards. Those that do often pose the disadvantage of added weight and bulk caused by the need for a heavy spring attachment to keep the cards in place.

The primary carrying device for credit cards and money for men and women has been in the form of a wallet or small pocketbook. With the attire which has been adopted by the public in casual, business or formal dress, wallets and pocketbooks have become bulky and in some instances uncomfortable when driving distances, or sitting in a theatre or restaurant. Furthermore, changes in the money and banking industry including the widespread use of the automated teller machines and consumer credit cards have changed the way people organize, handle and carry their money. Checkbooks are not as frequently used and cash can easily be obtained from a cash machine with a credit card. Women do not desire to carry a purse around with them which is clearly visible and can be easy target for a thief or placed aside and forgotten or displaced. It is now common to carry a small amount of money, the primary means for purchase or lease being credit which increases personal security as there is less to steal and less personal monetary risk. In addition to the monetary loss risk, a disturbing influence has cropped up in society which is directed toward personal risk in that persons with bulging pockets or pocketbooks may be subject to brutal attack and suffer physical and physiological harm through street attacks and robbery.

While money clips are a convenient way to carry folded money, they do not work very well in carrying credit cards, driver's licenses or other card identifications as the same tend to fall out of money clips or are bent, scratched, broken or destroyed by the money clip while being carried or removed.

It is estimated that by 1995 smart card technology will become common place providing yet another card sized identification device able to contain important personal information ranging from health information to banking, credit, telephone and other data.

These factors combine to create the need for a carrying device that can accommodate denominational money bills as well as a wide variety of credit card sized items. The carrying device should be capable of being carried in any pocket and also be capable of carrying up to ten different cards and a quantity of bills.

A number of patents have been obtained to attempt to provide a suitable currency or a credit card and identification carrier for individuals. U.S. Pat. No. 5,077,869 is directed towards a credit card/money clip device with a folded metal clip member adapted to hold folded currency and a T-shaped elastic band fastened to the clip member to retain credit cards and identification cards. U.S. Pat. No. 4,675,953 discloses a money clip with a base and operative clip member mounted to the base. The clip member has a pair of semi-elastic legs terminated in opposed staggered but parallel journals, pivotally mounted in bearings to provide offset parallel pivotal axes. The semi-elastic legs flex and cross through an over-center plane between a closed, clamping position and an inoperative open position. U.S. Pat. No. 3,555,623 discloses a paper money clip made of a length of spring wire in the form of a rectangular cylindrical helix on which is mounted a carrier plate. A resilient pad is secured to the coin facing surface of the carrier plate and functions with the bent over ears of the carrier plate to retain coins. U.S. Pat. No. 3,861,002 discloses a money clip constructed of a double clip member of spring wire or sheet spring material. A central clip element is common to both elements of the double clip which holds the money in place while allowing removal of a single bill from a stack of paper money. U.S. Pat. No. 3,623,193 discloses a money clip with a rectangular coiled spring structure held in place by an outer ring and inner disc medallion. The coiled spring has sufficient resiliency to open and close. U.S. Pat. No. 3,596,757 discloses a coin holding device, in combination with a paper money clip mounted within the framework of a paper money clip. The money clip is of the type having a rectangular helix of spring wire which functions to hold the paper money. The housing of the coin holder contains a resilient bowed plate which serves as a bias element for the coins and also encloses two legs of the money clip allowing the money clip and coin holding device to be operated independently of the other. U.S. Pat. No. 4,540,034 discloses a money clip mounted in a wallet, the clip being formed from resilient material and formed with two arms connected by a flexure section, the arms holding currency by virtue of a flexural torquing deformation around an axis through the flexure section.

As a result of the present need, the present invention is directed towards a new and improved credit card and money carrying device for conveniently carrying a number of credit sized cards, identification cards and folding monies in a convenient, easy manner in a pants pocket, shirt pocket or the like.

SUMMARY OF THE INVENTION

The inventive device has been designed specifically with flexible needs in mind. Made of flexible elastic, the inventive device is able to stretch exactly to the size of the given requirement. It's ability to return to its smallest size minimizes size and weight while accommodating differing requirements during different activities. The inventive device is therefore always low profile and easily accommodated in any pocket. It can easily be carried in shorts, pants, jeans or jackets, thereby accommodating today's preference for leisure and active wear apparel and life styles. Because it keeps everything constantly organized, it is also ideal for carrying personal items inside a jacket pocket or purse.

The new and improved credit card/money holding device comprises a rectangular elastic band member having end sides which are sewn together by zigzag stitching and held in place by a metallic cover plate member fixed to the elastic band member by crimping so that the plate covers and protects the sewn together ends and provides a decorative surface for engraving or placement of an emblem on the outer surface of the plate.

In accordance with the present invention, the new and improved credit card/money clip apparatus has a cover plate which can be made from metal or molded or formed from a plastic material. In the preferred embodiment, the plate is made from sheet metal stock selected from brass, bronze, aluminum, chrome, stainless steel, steel, pewter, silver, or other sheet metal stocks as well as gold or silver plated versions of any of the sheet metal stocks.

In the accompanying drawings, there is shown an illustrative embodiment of the invention from which these and other of objectives, novel features and advantages will be readily apparent.

BRIEF DESCRIPTION OF THE DRAWINGS

FIG. 1 is a perspective view of the new and improved credit card and money carrying device of the present invention showing folded currency and a credit card held in place in the device;

FIG. 2 is a top plan view of the improved credit card and money carrying device of the present invention showing the outer surface of the cover plate;

FIG. 3 is a bottom plan view of the improved credit card and money carrying device of the present invention with the band turned inside out from that shown in FIG. 1 and the under surface of the cover plate exposed;

DETAILED DESCRIPTION OF THE EMBODIMENT

Figure 4:
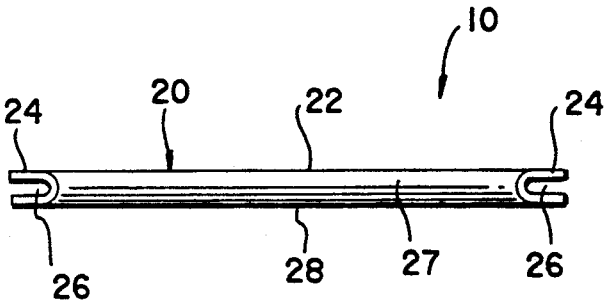
FIG. 4 is a side elevational view of the folded cover plate of the improved credit card and money carrying device without its elastic band.
Figure 5:
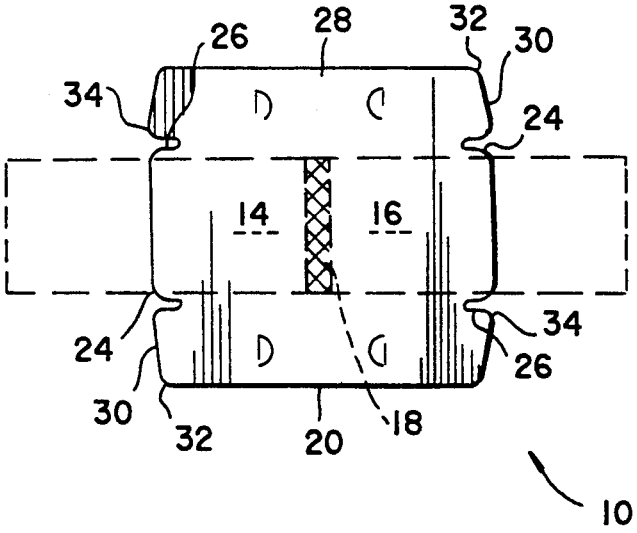
FIG. 5 is a top plan view of the stamp blank of the cover plate before the same is folded over and crimped on the elastic band.

The preferred embodiment and best mode of the invention is shown in FIGS. 1 through 5. In accordance with the invention, the improved credit card and money carrying device 10 provides a small compact, low profile economical device for carrying money, identification cards and credit cards by the user. The improved credit card and money carrying device 10 comprises a resilient elastic rectangular strap member 12 having opposing ends 14 and 16 which are sewn together with zigzag stitching 18 to form an endless elastic band 19. A cover plate member 20 constructed of metal is folded or bent over the band 19 and crimped at 36 to hold the cover plate 20 in a secure substantially fixed relationship with the band when it is stretched. The cover plate 20 is constructed with a top section 22 with rounded corners 24 leading to side slit notches 26. The slit notches 26 separate respective bottom sections 28, each of which is adjacent to the top section 22 allowing the plate to be folded over the band to form curved sides 27. Each of the bottom sections has inwardly inclined ends 30 with rounded corners 32 and 34.

The top section 22 can be provided with a patterned texture, engraving or have a decorative device such as a golf club, tennis racket, etc. mounted on its outer surface by adhesive, sonic welding, soldering or by providing an aperture in the top to receive a pin of the decorative ornament. In addition, to the aforementioned decorative ornament, a company or family crest, name or other identification can be mounted onto the outside of the plate in the manner described.

In accordance with the invention, the cover plate member 20 is preferably stamped and formed from a blank of sheet metal stock according to methods well known to those skilled in metal working. The gage or thickness of the metal sheet may vary depending on the metal but ranges typically from 0.025 inches to about 0.200 inches. The metal for forming the plate member can be selected from any suitable metal having physical properties suitable for stamping and forming operations and which possesses the necessary resilience for forming and crimping onto the elastic band 19. Accordingly, the metal may be selected from aluminum, brass, bronze, phosphor bronze, chrome, copper, pewter, tin, steel, stainless steel, gold, silver, platinum and various alloys and precious metal versions of metallic sheets.

The elastic band 19 is constructed of an elastic material that can be woven or braided and made of a combination rubber and polyester. The material is expandable to a finished stretch of 50% to 100% so as to easily and securely hold credit and other cards and foldable money. The band has a width of between $\frac{3}{4}$ inches and 1 inch and a finished length of 6 to 7 inches in circumference when joined together end to end, its ends 14 and 16 sewn together by a nylon thread with a zig zag stitching 18.

The elastic band 19 can also be formed from elastic fabric such as spandex or lycra-type fabric strips or tape. Other materials including rubber and leather may be used in conjunction with the elastic to augment or enhance the invention's appearance.

In the foregoing description, the invention has been described with reference to a particular preferred embodiment, although it is to be understood that specific details shown are merely illustrative, and the invention may be carried out in other ways without departing from the true spirit and scope of the following claims:

I claim:

1. A credit card and money carrying device comprising an endless band of elastic material, a plate member bent around said elastic band, said plate member being constructed with a top section with rounded edges and two integral bottom sections connected to said top section, decorative indicia means secured to a top surface of said top section, said bottom sections being spaced apart from each other and provided with inwardly inclined end edges, said plate member defining notches between said top section and said two integral bottom sections which lead into sides of said plate member when the same is bent around said elastic band, crimp means in said plate member providing plate member engagement into said elastic band thereby crimping said plate member into said elastic band.

2. A credit card and money carrying device as claimed in claim 1 wherein said plate member is stamped and formed from a sheet metal stock selected from brass, bronze, stainless steel, steel, chrome, pewter, tin, aluminum, silver and gold sheet metal stocks and gold or silver plated sheet metal stocks.

3. A credit card and money carrying device comprising a rectangular strip of elastic material with two ends sewn together by zig zag thread to form an elastic band, a metal plate member defining a top section and notch means on each side separating said top section from an integral bottom section, each bottom section having inwardly inclined ends, said metal plate member being folded around said elastic band so that integral bottom sections are folded adjacent each other with spacing there between, crimp means in said plate member bottom sections providing metal engagement into said elastic material thereby crimping the bottom plate sections into said elastic material holding said metal plate member in a fixed relationship on said band.

4. A credit card and money carrying device as claimed in claim 3 wherein said rectangular strip of elastic material ranges from ¾ to 1 inch in width and 6 to 7 inches in length.

5. A credit card and money carrying device as claimed in claim 3 wherein said elastic material is made of a combination of rubber and polyester.

* * * * *